United States Patent [19]

Noguchi

[11] 4,103,721

[45] Aug. 1, 1978

[54] METHOD AND APPARATUS FOR BOTTLING BEER

[75] Inventor: Sadao Noguchi, Nagoya, Japan

[73] Assignee: Mitsubishi Jukogyo Kabushiki Kaisha, Tokyo, Japan

[21] Appl. No.: 753,842

[22] Filed: Dec. 23, 1976

[51] Int. Cl.[2] ..... B65B 31/00; B67C 3/06

[52] U.S. Cl. ..... 141/6; 141/39; 141/49; 141/90; 141/302

[58] Field of Search ..... 141/1, 4–8, 141/13, 37, 39, 40, 44, 45, 46–50, 54–59, 61, 65, 66, 100, 104, 105, 129, 301, 302, 89–92

[56] References Cited

U.S. PATENT DOCUMENTS

| | | | |
|---|---|---|---|
| 2,679,346 | 5/1954 | Breeback | 141/6 |
| 3,699,740 | 10/1972 | Knabe | 141/6 X |
| 3,783,913 | 1/1974 | Trusselle | 141/46 |

*Primary Examiner*—Richard E. Aegerter
*Assistant Examiner*—Frederick R. Schmidt
*Attorney, Agent, or Firm*—Wenderoth, Lind & Ponack

[57] ABSTRACT

A beer bottling operation includes pressurizing the interior of an empty bottle prior to pouring beer into the bottle in two steps. In the first step, according to a first preferred embodiment, the interior of the bottle is pressurized by air fed from a pressurized air source, while in the second step the interior of the bottle is pressurized by means of pressurized air fed from a bottling tank where the beer to be bottled is stored. According to a second preferred embodiment, in the first step the interior of the bottle is evacuated substantial to a vacuum condition, while in the second step the interior of the bottle is pressurized by means of carbon dioxide gas fed from the bottling tank, and in the subsequent step of pouring beer into the bottle the beer is poured from the bottom portion of the bottle. According to another aspect of the invention, the blowing out of bubbles of beer, adhered to a pressurized gas passageway extending from the bottling tank and a bottling valve which have finished one cycle of a bottling operation, is divided into two steps. In the first step the bubbles are blown out by means of pressurized gas fed from the bottling tank, while in the second step the bubbles are blown out by means of pressurized air from the pressurized air source. By the above-mentioned provision, the amount of air that is inevitably dissolved in the beer within the bottling tank and in the bottled beer can be reduced, thereby resulting in improved quality of the bottled beer.

7 Claims, 10 Drawing Figures

METHOD AND APPARATUS FOR BOTTLING BEER

BACKGROUND OF THE INVENTION

The present invention relates to improvements in or relating to a method and apparatus for bottling beer.

At first, a beer bottling machine according to the prior art will be described with reference to FIG. 1 of the accompanying drawings. In this figure, reference numeral 1 designates an empty bottle to be filled with beer, numeral 2 designates a bottle feed screw, numeral 3 designates an inlet star wheel, numeral 4 designates a bottling machine, numeral 5 designates a transfer star wheel, numeral 6 designates a capping machine, and numeral 7 designates an outlet star wheel. Explaining bottling machine 4 in more detail with reference to FIGS. 2, 3 and 4, in FIG. 2 reference numeral 8 designates a machine body, numeral 9 designates a bottling tank provided at the center of the machine body, numeral 10 in FIGS. 2 and 3 designates a pillar member disposed at the center of the bottling tank 9, numerals 11 and 12 designate pressurized air passageways extending through pillar member 10 and opening at an upper portion of the bottling tank 9, numeral 13 designates a beer supply tube opening within bottling tank 9 at the bottom portion thereof, numeral 14 designates a float fitted around pillar member 10 in a vertically movable manner and floating on a beer surface (F) within the bottling tank 9, numeral 15 in FIG. 3 designates an upper valve fitted around a top portion of the pillar member 10 in a vertically movable manner, numeral 16 designates a lower valve fitted around the same top portion in a vertically movable manner, numeral 17 designates a compression spring interposed between respective valves 15 and 16, numeral 18 designates a float pin which is adapted to push up the lower valve 16 so as to open the aforementioned pressurized air feed passageway 11 when the beer surface (F) rises, resulting in a raising of the float 14, numeral 19 designates a float step which is adapted to push down the upper valve 15 so as to open the above-mentioned pressurized air discharge passageway 12 when the beer surface F falls, resulting in a lowering of the float 14, numeral 20 in FIG. 2 designates a plurality of bottling valves provided along the outer circumference of machine body 8, numeral 21 designates a switching lever for each said valve 20, numeral 22 designates a pressurized air passageway extending from the upper portion of bottling tank 9 to each valve 20, numeral 23 designates a beer passageway extending from the bottom portion of bottling tank 9 to each valve 20, numeral 22' in FIG. 4 designates a pressurized air passageway extending further from each valve 20, numeral 25 designates a beer pouring tube extending from each valve 20, and numeral 26 designates a centering bell mounted around each beer pouring tube 25 in a vertically movable manner.

The bottle feed screw 2 in FIG. 1 feeds empty bottles 1 which have been conveyed thereto to the inlet star wheel 3 under timing control, and star wheel 3 feeds the bottles towards the bottling machine 4. This bottling machine 4 is rotating in the direction of the arrow in FIG. 1. In addition, around the bottling machine 4 are provided bottle pedestals 27 (See FIGS. 2 and 4) which move round the bottling machine 4 in synchronization therewith, and which receive empty bottles 1 at a position *p* in FIG. 1 from the above-mentioned star wheel 3 and support the bottles thereon and thus begin to move the empty bottles 1 in the direction of the arrow. In other words, as shown on the left side in FIG. 2, an empty bottle 1 begins to move jointly with the centering bell 26 at the a position directly under the centering bell 26. It is to be noted that at this moment blow-out of air in the direction of arrows *a* does not exist. When the bottle pedestal 27 enters a pedestal rising section (A) in FIG. 1, it rises to raise the bottle 1 and cause the neck of the bottle to contact the centering bell 26. Thereafter, the centering bell 26 and the bottle 1 are further raised jointly, and when the bottle pedestal 27 has reached a position *q* in FIG. 1, the centering bell 26 is brought into contact with a packing 28 (See FIG. 4(II)). It is to be noted that as shown in FIG. 4(II), the beer pouring tube 25 is inserted into the bottle 1 during the above-described step of raising the bottle 1.

When the bottle pedestal 27 has reached the position *q* and the centering bell 26 makes contact with the packing 28, the bottling valve 20 is switched to the position shown in FIG. 4(III) by means of the switching lever 21 and a lever transfer device (not shown) which makes contact with the switching lever 21 to transfer the same, so that the pressurized air passageway 22 and the pressurized air passageway 22' are communicated with each other, resulting in a flow of pressurized air in the direction of arrows *e* in FIG. 2, and thus the interior of the bottle 1 is pressurized at a counter-pressure ($P_1$) (a counter-pressure within the bottling tank 9 as illustrated at I in FIG. 10. Therefore, when the bottle pedestal 27 has reached a position *s* in FIG. 1 passing through the counter-pressurizing section B, the interior of the bottle 1 and the interior of the bottling tank 9 are maintained at the same pressure. Pressurizing the interior of the bottle, which has previously been at atmospheric pressure, until it takes the same pressure as the interior of the bottling tank 9, is for the purpose of preventing carbon dioxide gas dissolved in the beer from escaping out of the beer during the subsequent bottling process.

Beer is fed into the bottling tank 9 through the beer supply tube 13. Also within tank 9 is maintained a counter-pressure. This counter-pressure is controlled by the float 14 in FIGS. 2 and 3. More particularly, if the beer surface F is raised, then the float 14 also rises, so that the lower valve 16 is pushed up by the pin 18 provided on the float 14 to open the pressurized air feed passageway 11, whereby pressurized air is fed into the bottling tank 9, and thereby the rise of the beer surface F can be prevented. On the other hand, if the beer surface is lowered, then the float 14 also falls, so that the upper valve 15 is pushed down by the step 19 provided on the float 14 to open the pressurized air discharge passageway 12, whereby pressurized air within the bottling tank 9 is discharged, and thereby lowering of the beer surface F can be prevented.

When the bottle pedestal 27 has reached a position *s* in FIG. 1 and the pressurizing operation for the bottle 1 has been completed, the bottling valve 20 is switched to the position shown at (IV) in FIG. 4 by means of the switching lever 21 and the lever transfer device (not shown), so that the pressurized air passageway 22 and the pressurized air passageway 22' are communicated with each other and also the beer passageway 23 and the beer pouring tube 25 are communicated with each other. Consequently, beer flows in the direction of arrow *c* in FIG. 2. In other words, beer is poured from the bottling tank 9, through the beer passageway 23 and the beer pouring tube 25 into the bottle 1. Then the air within the bottle flows in the direction of arrows *d* in FIG. 2. That is, the air within the bottle is discharged through the pressurized air passageways 22' and 22 into the bottling tank 9. The pouring of beer and the discharge of pressurized air within the bottle continue during the period when the bottle pedestal 27 passes through the bottling section C, and these operations have been completed when the bottle pedestal 27 reaches a position *t* in FIG. 1. In addition, when it reaches the position *t*, the bottling valve 20 is switched by means of the switching lever 21 and the lever transfer device, so that the paths between the pressurized air passageways 22 and 22' and between the beer passageway 23 and the beer pouring tube 25 may be blocked.

When the bottle pedestal 27 enters a pedestal lowering section D passing through the position *t*, it falls to lower the bottle 1 which has finished bottling, and eventually to lower the centering bell 26 down to the lower end of the pouring tube 25 and to lower the bottle 1 further below the centering bell 26. It is to be noted that at this moment blow-out of air in the direction of arrows *a* does not exist. The bottle pedestal 27 delivers the bottle 1 thereon to the transfer star wheel 5 when it comes out of the pedestal lowering section D and has reached a position *u* in FIG. 1, and the transfer star wheel 5 transfers the bottle 1 to the capping machine 6. This capping machine 6 applies a crown cap to the bottle 1 and feeds the capped bottle 1 to the outlet star wheel 7, which serves to discharge the filled bottle onto a conveyor line.

On the other hand, the bottling valve 20 which has moved jointly with the bottle 1 up to the position *u* in FIG. 1, separates from the bottle 1 when it has reached the position *u*, and enters a blow-out section E from a position *v* in FIG. 1. At this position *v*, the valve 20 is switched to a position (I) in FIG. 4 by means of the switching lever 21 and the lever transfer device, so that the pressurized air passageway 22 and 22' are communicated with each other, the pressurized air within the bottling tank 9 flows at blow-out pressure $T_1$ through the respective passageways 22 and 22' in the direction of arrows *b* in FIG. 2, and is blown out from the end of the passageway 22' in the direction of arrows *a* in FIG. 4(I). Discharging the pressurized air within the bottling tank 9 in this way in the blow-out section E, is for the purpose of blowing out bubbles of beer which remain and adhere to the interior of the bottling valve 20 and the pressurized air passageway 22'. If such provision should not be made, then when the bottling valve 20 again enters the bottling section C and beer is fed from the bottling tank 9 to the bottle 1, the interior of the bottle 1 would bubble, resulting in degradation of the quality of the beer, because the bubbles adhered to the above-mentioned portions would flow into the bottle 1 jointly with the flow of pressurized air in the direction of arrows *e* in FIG. 2 in the counter-pressurizing section B. The bottling valve 20 which has been subjected to such blow-out operation, closes its pressurized air passageway 22 when it goes out of the blow-out section E.

When the bottling valve 20 and the bottle pedestal 27 have come to the position *p* in FIG. 1, they again join with an empty bottle 1 supplied from the inlet star wheel 3 as shown on the left side in FIG. 2 to repeat the bottling cycle, and the other bottling valves 20 disposed along the outer circumference of the machine body 8 also move and operate in a similar manner so as to repeat the bottling cycles.

In the above described prior art beer bottling machine, when the bottle 1 is fed to the counter-pressurizing section (B), the counter-pressurizing operation is carried out by feeding the pressurized air within the bottling tank 9 into the interior of the bottle 1. Also, when each bottling valve 20 has moved to the blow-out section E, the bubbles of beer adhered to the inside of each valve 20 and to the inside of the pressurized air passageways 22 and 22' associated with each valve 20 are blown out by feeding the pressurized air within the bottling tank 9 to these inside portions, and therefore, a large amount of air is necessitated. Since such air is supplied into the bottling tank 9 through the pressurized air feed passageway 11 and flows along the surface of beer F, the prior art bottling machine has a disadvantage that the amount of air inevitably dissolved in the beer is increased, resulting in degradation of the quality of the bottled beer.

The above-described prior art problems can be resolved either by feeding the air to be used for the counter-pressurizing operation and the air to be used for the blow-out operation from a separate pressurized air source, that is, without passing the air through the bottling tank, or by replacing the air supplied to the bottling tank with carbon dioxide. However, in the case of the former approach above, the following problem still remains in connection with the pressurizing section B and the bottling section C. That is, when the bottle 1 enters the bottling section C, if the pressure within the bottle 1 should be lower than that within the bottling tank 9 even by a little, then bubbling would occur within the bottle 1, and this is not desirable. On the other hand, the pressure within the bottling tank 9 is always varying as controlled by the float 14. The reason why the interior of the bottle 1 is pressurized by the counter-pressure within the bottling tank 9 by providing the counter-pressurizing section B prior to the bottling section C as described previously, is because of such pressure variation within the bottling tank 9. Therefore, if the interior of the bottle 1 is pressurized by the pressurized air fed from a separate pressurized air source as described above, then the pressure of such pressurized air source must be controlled so as to follow the counter-pressure variation within the bottling tank 9, and thus there remain the problems that a complex and expensive pressure control device is required, and that even with such a pressure control device it is still impossible to make the pressure of the pressurized air source exactly follow the counter-pressure variation within the bottling tank 9.

It is to be noted that the blow-out operation is carried out for the purpose of blowing out the bubbles of beer adhered to the pressurized air passageway and the bottling valve as described above, and the amount of air passing through the bottling tank thereupon is far larger than that upon the counter-pressurizing in which merely the interior of the bottle is pressurized. Therefore, in order to reduce the amount of air dissolved in beer, it is a serious problem to minimize the amount of air within the bottling tank to be fed to the blow-out section to as little as possible.

On the other hand, one example of the heretofore known beer bottling machines in accordance with the latter approach above for resolving the prior art problems, that is, in the case of replacing the air supplied to the bottling tank with carbon dioxide gas, will be described hereunder with reference to FIG. 5. In this figure, reference numeral 51 designates an empty bottle, numeral 52 designates a bottling tank, numeral 53 designates a vacuum ring, numeral 54 designates an operation lever, numeral 55 designates an air valve, numeral 56 designates a liquid valve, numeral 57 designates a spreader, numeral 58 designates a vent tube, numeral 59 designates a post spring, numeral 60 designates a vacuum valve, and numeral 61 designates a snifting valve. At (I) in FIG. 5 is shown a state where the bottling tank 52 is filled with beer, and both the air valve 55 and the liquid valve 56 are closed. Then the empty bottle 51 is fed, and the vacuum valve 60 is switched to communicate the vacuum ring 53 with the empty bottle 51, so that the air within the bottle 51 is removed. When the air within the bottle has been removed by about 80 – 90%, as shown at (II) in FIG. 5 the vacuum valve 60 is switched to a closed position and at the same time the air valve 55 is switched to an opened position by means of the operation lever 54, so that the carbon dioxide gas within the bottling tank 52 is fed into the bottle 51, and thereby the interior of the bottle 51 is pressurized by the counter-pressure. When the pressure within the bottle 51 becomes equal to the counter-pressure, as shown at III in FIG. 5, the liquid valve 56 is switched by the post spring 59 to an opened position, so that beer is fed from the bottling tank 52 through the valve 56 and an outer periphery of the spreader 57 into the bottle 51. In this case, beer is dispersed by the action of the spreader 57 and flows down in a thin film form along the inner wall surface of the bottle 51. The purity of carbon dioxide gas in the upper portion of the bottling tank 52 depends upon the method of operation of the bottling machine, but in general it contains about 20% air. Upon pouring beer, the gas within the bottle 51 is returned via the vent tube 58 and the air valve 55 to the interior of the tank 52. When the surface level of beer within the bottle 51 becomes higher than the lower end of the vent tube 58 as shown at (IV) in FIG. 5 and the flow of beer into the bottle 52 is stopped, the operation lever 54 is depressed, so that the air valve 55 and the liquid valve 56 are closed, then the snifting valve 61 is switched so as to discharge the gas in the upper portion of the bottle 51 to the exterior as shown at V in FIG. 5.

In the above-described beer bottling machine, the gas in the upper portion of the bottling tank 52 is a mixture gas consisting of about 80% carbon dioxide gas and about 20% air, because the rate of removal of air within the bottle 52 in the step shown at (I) in FIG. 5 is about 80 – 90%, with about 20 – 10% air remaining in the bottle, and this air is returned to the bottling tank 52 in the step shown at (III) in FIG. 5. Thus, although the amount of air inevitably dissolved in beer within the bottling tank 52 can be reduced in comparison to the prior art beer bottling machine as shown in FIGS. 1 to 4, the problem of minimizing the amount of air dissolved in beer within the bottle 51 is not yet resolved. More particularly, beer would flow from the outer periphery of the vent tube 58 to the inside of the bottle 51 and then would flow down along the inner wall surface of the bottle 51, while a gas mixture as described above exists in the bottle 51, and therefore, as the air contained in the gas mixture makes contact with the beer that is flowing down, dissolution of the air in the beer would occur. In order to minimize the dissolution, the surface area of the beer within the bottle 51 must be reduced. However, since the above-described beer bottling machine employs an up-bottling system, in which beer is made to flow from the outer periphery of the vent tube 58 to the inside of the bottle 51 and then flow down along the inner wall surface of the bottle, the surface area of beer is large, and so, the above-described bottling machine has a disadvantage that the amount of air inevitably dissolved in the beer within the bottle 51 is large.

SUMMARY OF THE INVENTION

Therefore, it is a principal object of the present invention to provide an improved method and apparatus for bottling beer, in which the above-described problems in the prior art are resolved, and in which an amount of air inevitably dissolved in beer within a bottling tank and within a bottle can be reduced.

According to one feature of the present invention, the improved method and apparatus for bottling beer is characterized by leading a supplied empty bottle to a first counter-pressurizing section to pressurize the interior of the bottle by means of pressurized air fed from a pressurized air source, then leading the bottle to a second counter-pressurizing section to pressurize the interior of the bottle by means of pressurized air fed from a bottling tank until the interior of the bottle is at the same pressure as the counter-pressure within the bottling tank, and leading the bottle to a bottling section to pour beer into the bottle.

In this method and apparatus for bottling beer, since a supplied empty bottle is led to a first counter-pressurizing section to pressurize the interior of the bottle by means of pressurized air fed from a pressurized air source and then the bottle is led to a second counter-pressurizing section to pressurize the interior of the bottle by means of pressurized air fed from a bottling tank until the interior of the bottle is at the same pressure as the counter-pressure within the bottling tank, the pressurizing by means of the pressurized air within the bottling tank is carried out only in the second counter-pressurizing section among the respective counter-pressurizing sections. Furthermore, the interior of the bottle which enters the second counter-pressurizing section has been already pressurized to a considerable extent, so that it is only necessary to feed a small amount of pressurized air, for which the air returned from the interior of the bottle to the bottling tank in the bottling step can be utilized. Accordingly, there is no need to feed pressurized air to the bottling tank for the purpose of counter-pressurizing (there is no air flow passing through the bottling tank), and so, dissolution of air in beer within the bottling tank can be prevented. In addition, since the empty bottle is led to a second counter-pressurizing section to pressurize the interior of the bottle by means of pressurized air fed from a bottling tank until the interior of the bottle is at the same pressure as the counter-pressure within the bottling tank, a pressure control device is not required, despite the fact that in the first step the interior of the bottle is pressurized by feeding pressurized air from a pressurized air source into the bottle.

According to another feature of the present invention, the improved method and apparatus for bottling beer is characterized by leading a pressurized gas passageway extending from a bottling tank and a bottling valve to which bubbles of beer adhere upon coming out of a bottling section to a first blow-out section to blow out the bubbles towards the bottling valve by means of pressurized gas fed from the bottling tank, and then leading the same to a second blow-out section to blow out the bubbles to the exterior by means of pressurized air fed from a pressurized air source.

In this method and apparatus for bottling beer, since a pressurized gas passageway extending from a bottling tank and a bottling valve to which bubbles of beer adhere upon coming out of a bottling section is led to a first blow-out section to blow out the bubbles towards the bottling valve by means of pressurized gas fed from the bottling tank, and then the same is led to a second blow-out section to blow out the bubbles to the exterior by means of pressurized air fed from a pressurized air source, then in the case where the pressurized gas within the bottling tank is air, the section necessitating the pressurized air within the bottling tank is only the first blow-out section among the respective blow-out sections. Furthermore, since the first blow-out section functions merely to move the bubbles adhered to the pressurized air passageway towards the bottling valve, it is only necessary to feed a small amount of pressurized air from the bottling tank. It is to be noted that what discharges the bubbles completely to the exterior is pressurized air fed from a pressurized air source. Consequently, in the case where the pressurized gas within the bottling tank is air, the air returned from the interior of the bottle to the bottling tank in the bottling step can be utilized in the first blow-out section, and owing to such utilization of air as well as the above-described fact that the pressurized air for completely discharging the bubbles is fed from a pressurized air source, there is no need to feed pressurized air to the bottling tank for the purpose of blow-out operations (there is no flow of air passing through the bottling tank), so that dissolution of air in beer within the bottling tank can be prevented.

According to still another feature of the present invention, the improved method and apparatus for bottling beer is characterized by leading a supplied empty bottle to a pre-evacuating section to bring the interior of the bottle to a nearly vacuum state, then leading the bottle to a counter-pressurizing section to pressurize the interior of the bottle by means of carbon dioxide gas fed from a bottling tank until the interior of the bottle is at the same pressure as the counter-pressure within the bottling tank, and leading the bottle to a bottling section to pour beer into the bottle from the bottom portion of the bottle.

In this method and apparatus for bottling beer, since a supplied empty bottle is led to a pre-evacuating section to bring the interior of the bottle to a nearly vacuum state and then the bottle is led to a counter-pressurizing section to pressurize the interior of the bottle by means of carbon dioxide gas fed from a bottling tank until the interior of the bottle is at the same pressure as the counter-pressure within the bottling tank, the amount of air dissolved in the beer within the bottling tank can be reduced in comparison to the conventional method for bottling in which pressurized air within the bottling tank is utilized for pressurizing the interior of the bottle. Furthermore, in this method and apparatus for bottling beer, since the above-described pressurized bottle is led to a bottling section to pour beer into the bottle from the bottom portion of the bottle, the beer surface contacting with the gas in the bottle takes a cross-sectional plane of the bottle which rises as the beer is poured, and thus the surface area of the beer contacting with the gas in the bottle can be widely reduced in comparison to the above-described method for bottling beer according to an upbottling system, so that even if air is contained in the carbon dioxide gas supplied to the empty bottle, the amount of air inevitably dissolved in the beer within the bottle can be reduced.

BRIEF DESCRIPTION OF THE DRAWINGS

The above mentioned and other features and objects of this invention will become more apparent by reference to the following description taken in conjunction with the accompanying drawings, in which.

DETAILED DESCRIPTION OF THE INVENTION

Figure 1:
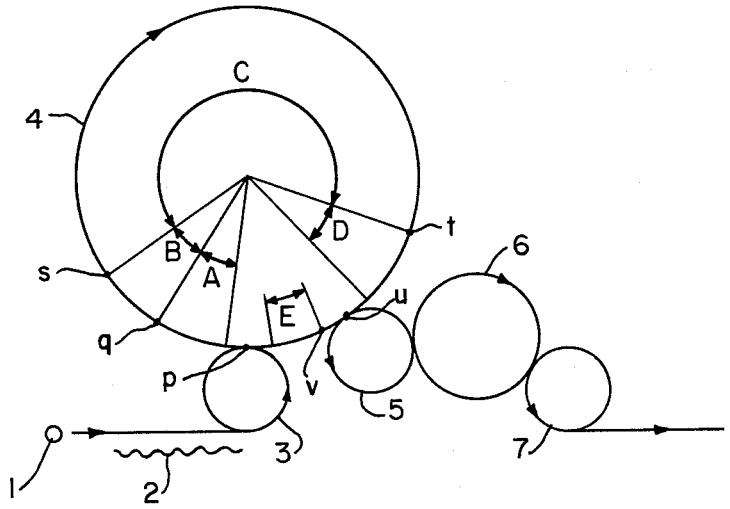
FIG. 1 PRIOR ART
FIG. 1 is a schematic plan view showing a prior art beer bottling machine.
Figure 2:
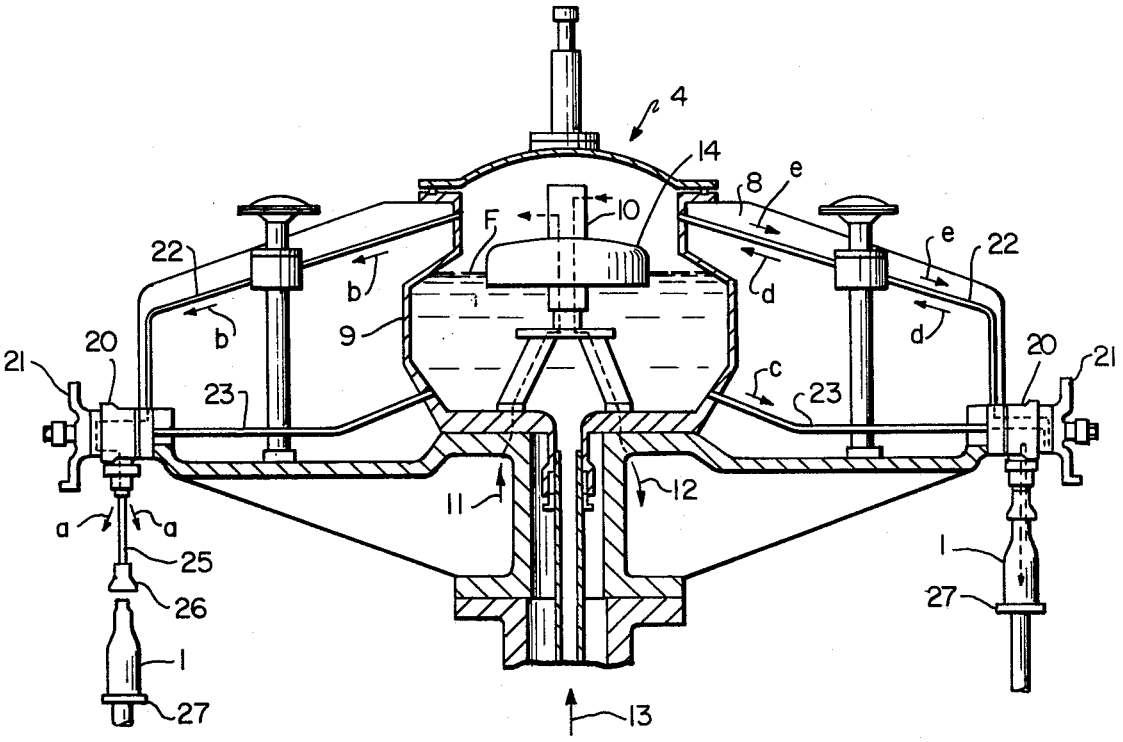
FIG. 2 PRIOR ART
FIG. 2 is a longitudinal cross sectional side view of the bottling machine of FIG. 1.
Figure 3:
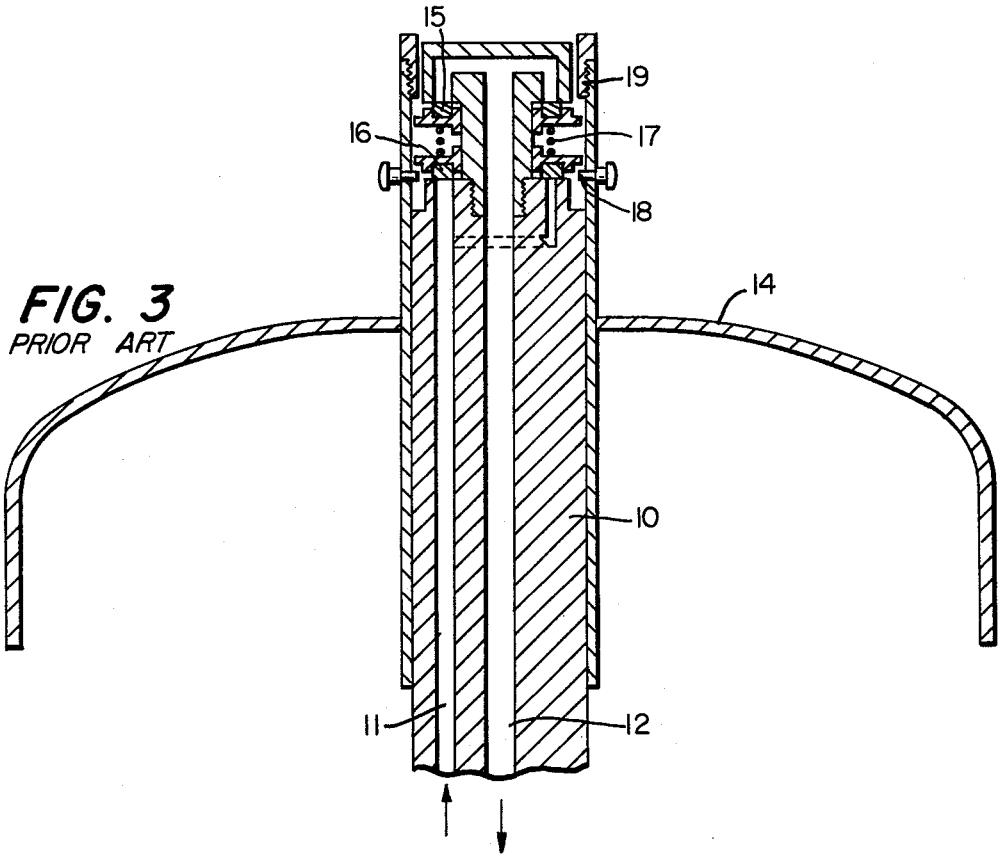
FIG. 3 PRIOR ART
FIG. 3 is an enlarged longitudinal cross-sectional side view showing a float section of the bottling machine of FIG. 2.
Figure 6:
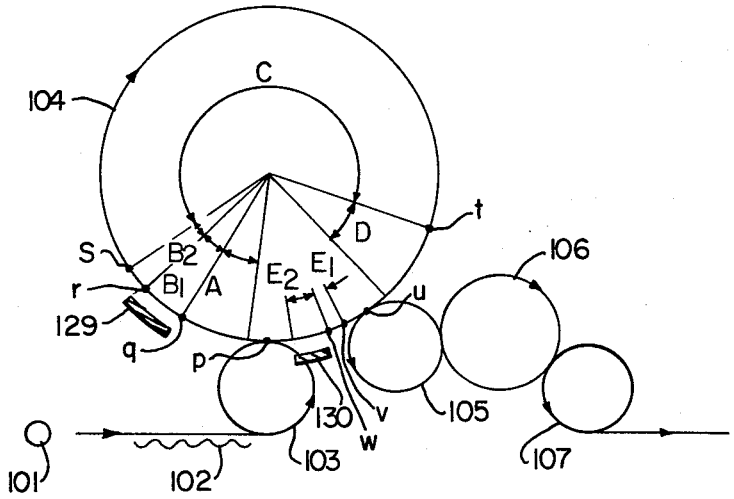
FIG. 6 is a schematic plan view showing one preferred embodiment of a beer bottling machine according to the present invention.

A beer bottling machine embodying one feature and another feature of the present invention will now be described in more detail in connection with the machine structure illustrated in FIGS. 6, 7, 8 and 9. With reference to FIG. 6, reference numeral 101 designates an empty bottle to be filled with beer, numeral 102 designates a bottle feed screw, numeral 103 designates an inlet star wheel, numeral 104 designates a bottling machine, numeral 105 designates a transfer star wheel, numeral 106 designates a capping machine, and numeral 107 designates an outlet star wheel. Explaining bottling machine 104 in more detail with reference to FIGS. 7, 8 and 9, in FIGS. 7 and 8 reference numeral 108 designates a machine body, numeral 109 designates a bottling tank provided at the center of the machine body 108, numeral 110 designates a pillar member disposed at the center of the bottling tank 109, numerals 111 and 112 designate pressurized air passageways extending through the pillar member 110 and opening at the upper portions thereof within the bottling tank 109, numeral 113 designates a beer supply tube opening into the bottom of the bottling tank 109, and numeral 114 designates a float fitted around the pillar member 110 in a vertically movable manner and floating on a beer surface F within the bottling tank 109, which float is provided with an upper valve, a lower valve, a pin and a step as shown in FIG. 3. In addition, reference numeral 120 designates a plurality of bottling valves provided along the outer circumference of the machine body 108 (and of a construction similar to valves 20 shown in FIG. 4), numeral 121 designates a switching lever for each valve 120, numeral 122 designates a pressurized air passageway extending from the upper portion of the bottling tank 109 to each valve 120, and numeral 123 designates a beer passageway extending from the bottom of the bottling tank 109 to each valve 120. Still further, in FIGS. 7, 8 and 9, reference numeral 109' and 109'' designate upper and lower manifolds (a pressurized air source), numeral 122' designates a pressurized air passageway extending from the upper manifold 109' to the pressurized air passageway 122, numeral 122'' designates a pressurized air passageway extending from the lower manifold 109'' to the pressurized air passageway 122, numeral 120' designates a first switching valve, numeral 120'' designates a second switching valve, numeral 121' designates a switching lever for the first switching valve 120', and numeral 121'' designates a switching lever for the second switching valve 120''. Reference numeral 128 in FIG. 9 designates a rotary joint mounted at the center of the upper portion of the bottling tank 109, and pressurized air is adapted to be fed to the upper and lower manifolds 109' and 109'' via the rotary joint 128. In addition, reference numeral 125 designates a beer pouring tube, numeral 127 designates a bottle pedestal, and reference numerals 129 and 130 in FIGS. 6, 7 and 8 designate lever transfer devices for operating the switching levers 121' and 121'' of the first and second switching valves 120' and 120'', respectively.

Now the operation of the above-described beer bottling machine will be explained. The bottle feed screw 102 feeds the supplied empty bottles 101 to the inlet star wheel 103 under timing control, and the star wheel 103 transfers the empty bottles 101 towards the bottling machine 104. This bottling machine 104 is rotating in the direction indicated by an arrow in FIG. 6. Around the bottling machine 104 are provided bottle pedestals 127 which move round the bottling machine 104 in synchronization therewith, and which receive empty bottles 101 arriving at a position (*p*) in FIG. 6 from the aforementioned star wheel 103 and support the bottles thereon and thus begin to move the empty bottles 101 in the direction of the arrow. That is, the empty bottle 101 begins to move jointly with the centering bell 126 while maintaining a position immediately under the centering bell 126. This position is shown on the left side in FIG. 7. It is to be noted that at this moment blow-out of air in the direction of arrows *a* does not exist. When the bottle pedestal 127 enters a pedestal rising section A in FIG. 6, it rises to raise the bottle 101 and make a neck of the bottle contact with the centering bell 126. Thereafter, the centering bell 126 and the bottle 101 are further raised jointly, and when the bottle pedestal 127 has reached a position *q* in FIG. 6, the centering bell 126 is brought into contact with a packing, similar to 28 in FIG. 4(II). On the other hand, the beer pouring tube 125 is inserted into the bottle 101 during the above-described step of raising the bottle 101.

Figure 4:
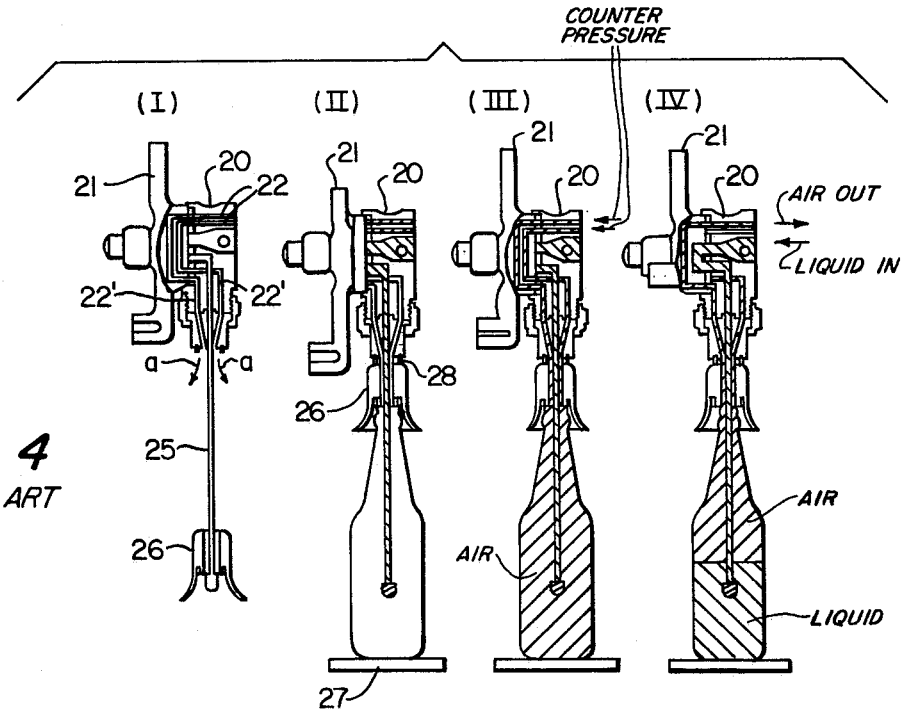
FIG. 4 PRIOR ART
FIG. 4 is a longitudinal cross-sectional side view showing a bottling valve of the bottling machine of FIG. 2 at different positions thereof.
Figure 5:
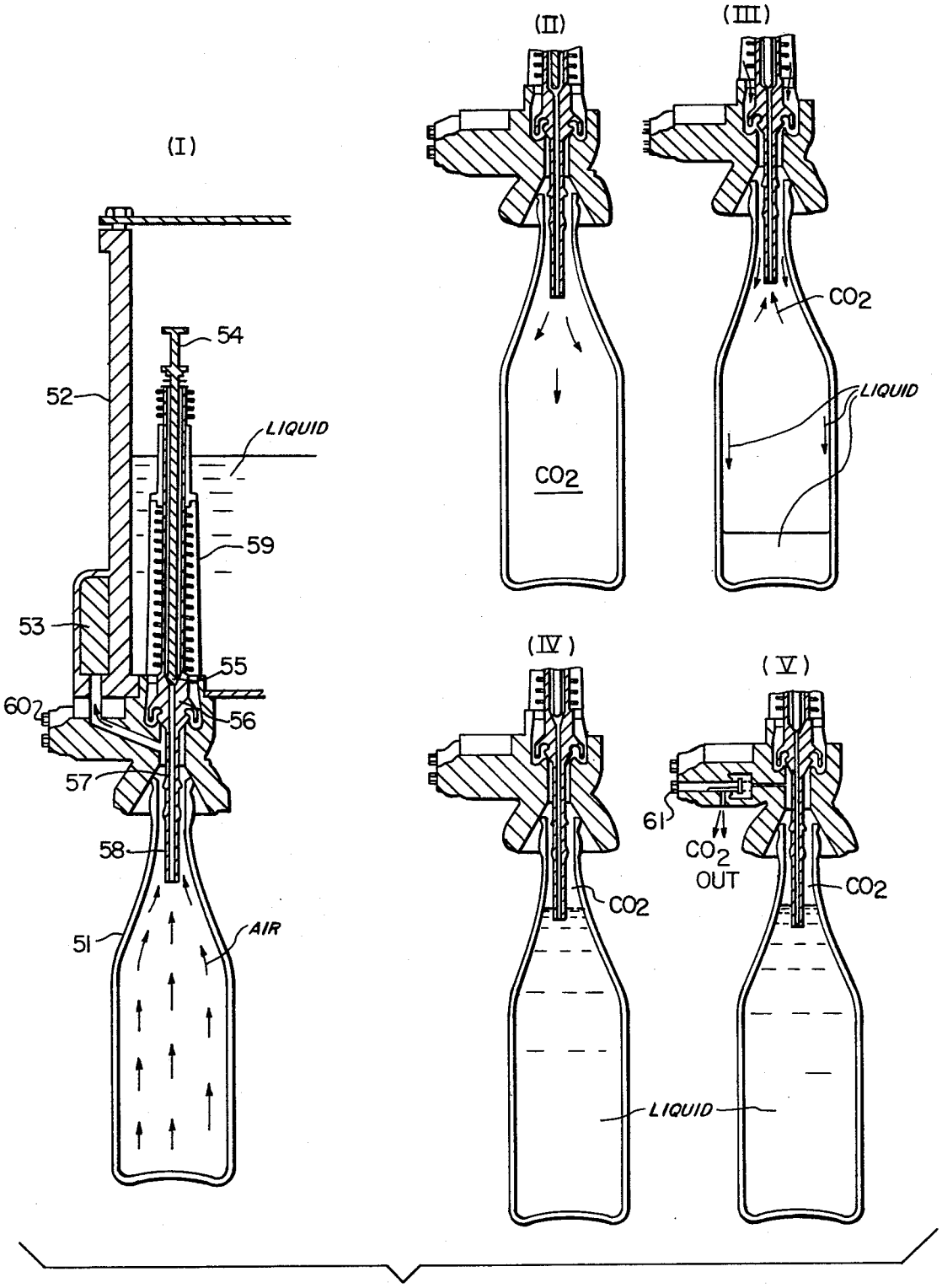
FIG. 5 PRIOR ART
FIG. 5 is a longitudinal cross-sectional side view showing mainly the section of a bottling valve of another prior art beer bottling machine at different positions thereof.

When the bottle pedestal 127 has reached the position *q* and the centering bell 126 makes contact with the packing as described above, the bottling valve 120 is switched to a position shown in FIG. 4(III) by means of the switching lever 121 and a lever transfer device (not shown), so that the pressurized air passageway 122 is opened. At the same time the switching lever 121' for the first switching valve 120' makes contact with the lever transfer device 129 as shown on the right side in FIG. 7, so that the first switching valve 120' is switched in such manner that a tank side branch of the pressurized air passageway 122 may be blocked while a bottling valve side branch of the passageway 122 may be communicated with the pressurized air passageway 122'. Consequently, pressurized air within the manifold 109' flows in the direction of arrow *f*, so that the interior of the bottle 101 is pressurized at a counter-pressure $P_2$ shown at (II) in FIG. 10 (the pressure within the manifold 109', and when the bottle pedestal 127 has reached a position *r* in FIG. 6 after passing through a first counter-pressurizing section $B_1$, the interior of the bottle 101 takes the same pressure as the manifold 109'. It is to be noted that this pressure is slightly lower than the pressure within the bottling tank 109.

Figure 8:
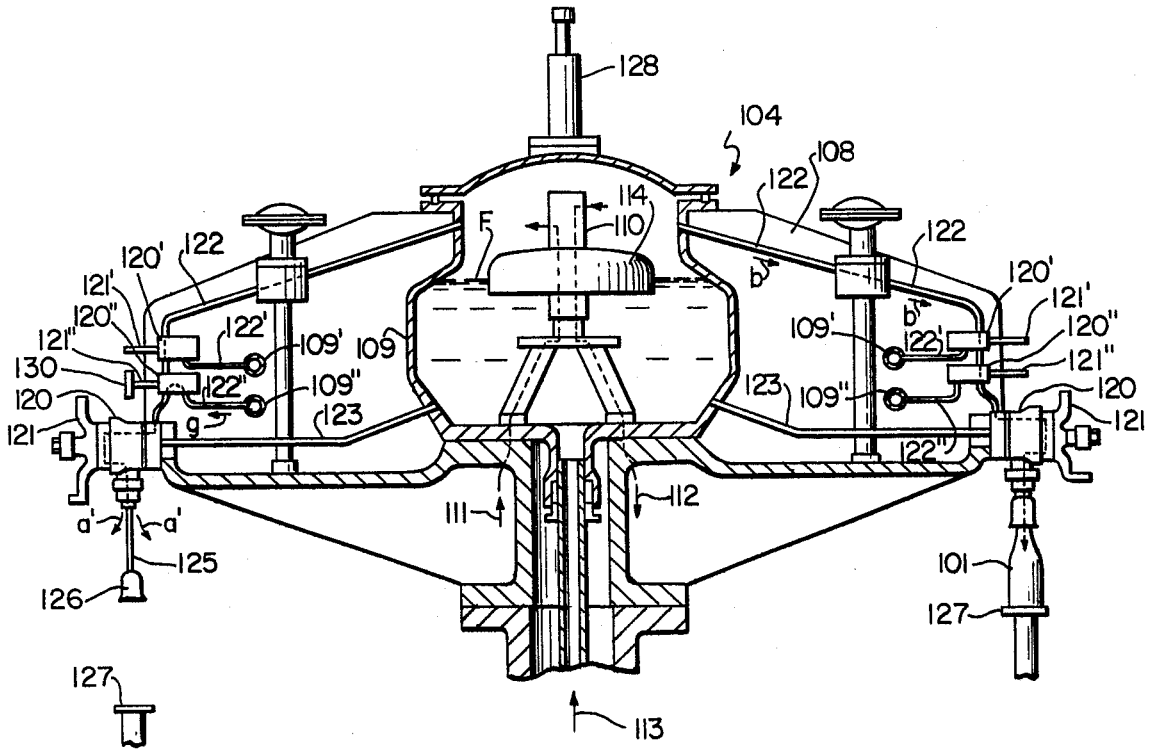
Figure 9:
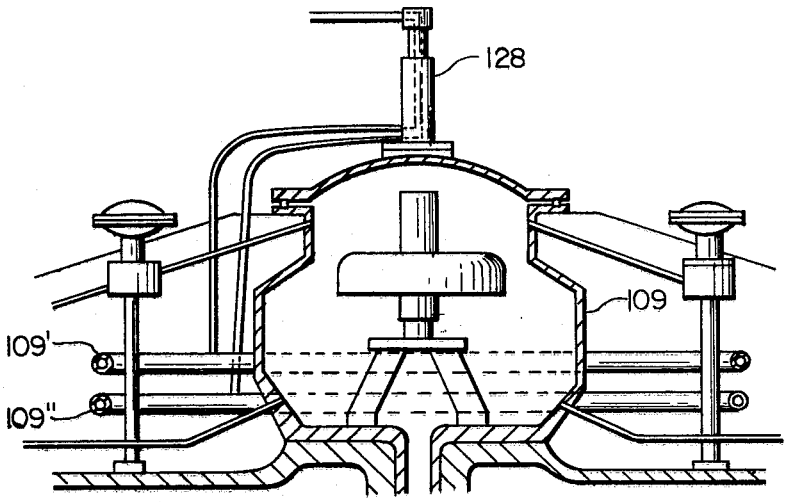
FIG. 9 is a longitudinal cross-sectional side view showing a pressurized air source in the bottling machine of FIG. 6.
Figure 10:
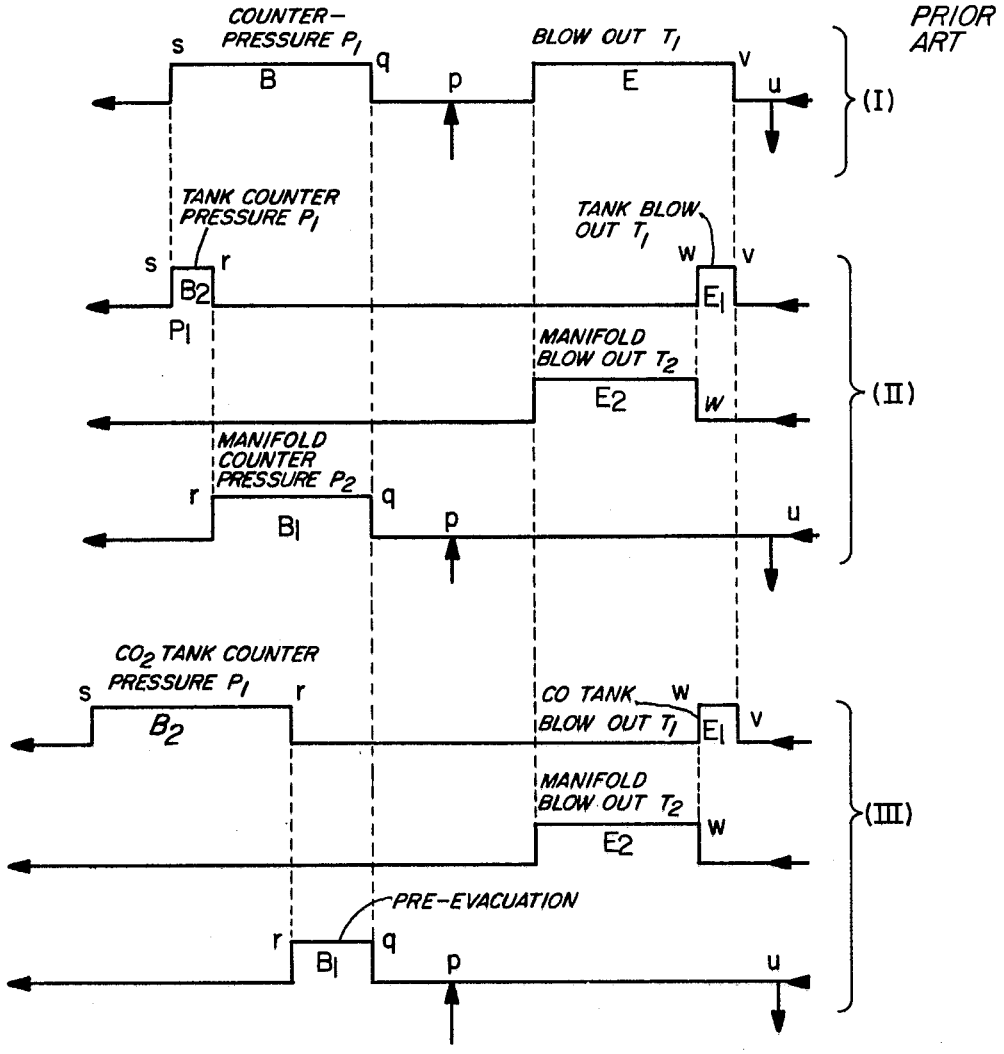
FIG. 10 is a time chart diagrammatically showing the sequence of operations in a prior art bottling machine (I) and in bottling machines according to the present invention (II and III).

When the bottle pedestal 127 enters a second counter-pressurizing section $B_2$, the switching lever 121' for the first switching valve 120' leaves the lever transfer device 129 and thereby the first switching valve 120' is restored to its original state, where the tank side branch and the bottling valve side branch of the pressurized air passageway 122 are communicated with each other and pressurized air flows in the direction of arrows *b* as shown on the right side in FIG. 8, so that the interior of the bottle 101 is pressurized by the counter-pressure $P_1$ shown at (II) in FIG. 10 (the pressure within the bottling tank 109), and when the bottle pedestal 127 has reached a position S in FIG. 6 after passing through the second counter-pressurizing section $B_2$, the interior of the bottle 101 is at the same pressure as the interior of the bottling tank 109.

Subsequently, the bottle pedestal 127 enters a bottling section C, where the bottling valve 120 is switched by the switching lever 121 and the lever transfer device to the state shown at (IV) in FIG. 4, so that the pressurized air passageway 122 is maintained in an opened state, while the beer passageway 123 and the beer pouring tube 125 are communicated with each other. Consequently, beer is poured into the bottle 101 through the passageway 123 and the beer pouring tube 125. This bottling operation continues during the period when the bottle pedestal 127 is passing through the bottling section C, and it has been completed when it reaches a position *t* in FIG. 6. When the bottle pedestal 127 has reached the position *t*, the bottling valve 120 is switched by means of the switching lever 121 and the lever transfer device, so that the pressurized air passageway 122 and the beer passageway 123 are blocked.

When the bottle pedestal 127 enters a pedestal lowering section D passing through the position *t*, it falls to lower the bottle 101 which has finished bottling, and eventually to lower the centering bell 126 down to the lower end of the pouring tube 125 and to lower the bottle 101 further below the centering bell 126, as shown on the left side in FIG. 7. It is to be noted that at this moment blow-out of air in the direction of arrows *a* does not exist. The bottle pedestal 127 delivers the bottle 101 thereon to the transfer star wheel 105 when it comes out of the pedestal lowering section D and has reached a position *u* in FIG. 6, and the transfer star wheel 105 transfers the bottle 101 to the capping machine 106. This capping machine 106 applies a crown cap to the bottle 101 and feeds the capped bottle 101 to the outlet star wheel 107, which serves to discharge the filled bottle onto a conveyor line.

On the other hand, the bottling valve 120 and the first and second switching valves 120' and 120'' which have moved jointly with the bottle 101 up to the position *u* in FIG. 6, separate from the bottle 101 when they have reached the position *u* and enter a first blow-out section $E_1$ at a position *v* in FIG. 6. At this position *v*, the bottling valve 120 is switched to a position (I) in FIG. 4 by means of the switching lever 121 and the lever transfer device, so that the pressurized air passageway 122 is opened, and the pressurized air within the bottling tank 109 flows in the direction of arrows *h* as shown on the left side in FIG. 7 and is discharged (blown out) from the end of the passageway 122 in the direction of arrows *a*. It is to be noted that at this moment a bottle 101 is not positioned under the respective centering bell 126. A reference character $T_1$ at (II) in FIG. 10 indicates this first blow-out operation. Such a first blow-out operation is effected for the purpose of moving bubbles of beer which adhere to the interior of the pressurized air passageway 122 towards the bottling valve 120, and therefore, it is only necessary to blow out a small amount of air. For the above-described counter-pressurizing $P_1$ and the blow-out $T_1$, the following air is utilized. That is, while it has been already described that air within the bottle is returned to the bottling tank during the bottling operation, this air can be used for the above-described counter-pressurizing $P_1$ and the blow-out $T_1$. Accordingly, there is no need to supplement air from the pressurized air passageway 111 to the bottling tank 109 for the purpose of the above-described counter-pressurizing $P_1$ and the blow-out $T_1$.

The bottling valve 120 and the first and second switching valves 120' and 120'' enter a second blow-out section $E_2$ from a position *w* in FIG. 6. As shown on the left side in FIG. 8, at this position *w* the switching lever 121'' for the second switching valve 120'' makes contact with the lever transfer device 130, so that the second switching valve 120'' is switched in such manner that a tank side branch of the pressurized air passageway 122 may be blocked, while a bottling valve side branch of the passageway 122 and the pressurized air passageway 122'' may be communicated with each other. Consequently, pressurized air within the manifold 109'' flows through the passageway 122'' and the bottling valve 120 in the direction of arrow *g*, and is blown out from the end of the passageway 122'' in the direction of arrows *a'*, as shown on the left side in FIG. 8. Reference character $T_2$ at (II) in FIG. 10 represents this second blow-out operation. Such blow-out operation is effected for the purpose of blowing out bubbles of beer being moved through the passageway 122 towards the bottling valve 120 as well as bubbles of beer adhered to the inside of the bottling valve 120. The second switching valve 120'' which has achieved the second blow-out $T_2$ is switched when it comes out of the second blow-out section $E_2$ because the switching lever 121'' leaves the lever transfer device 130, so that a tank side branch and a bottling valve side branch of the pressurized air passageway 122 are communicated with each other, and the passageway 122 and the pressurized air passageway 122'' are blocked from each other. At the same time, the bottling valve 120 is switched by means of the switching lever 121 and the lever transfer device, resulting in blocking of the aforementioned passageway 122.

Figure 7:
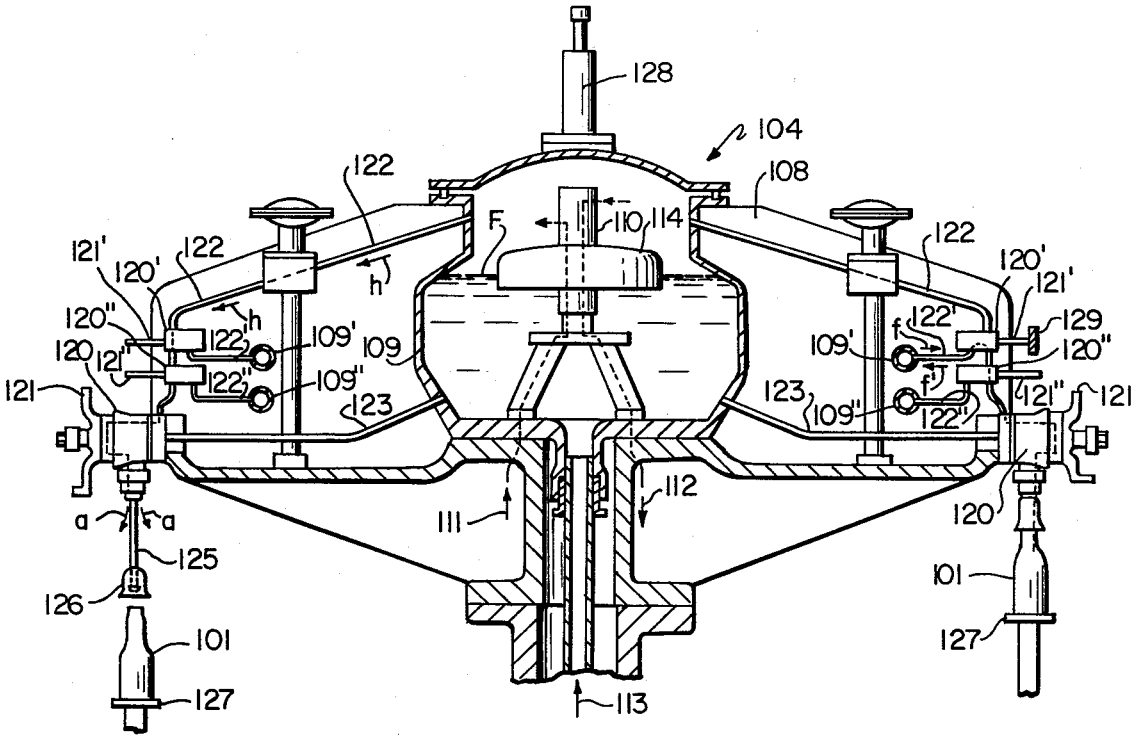
FIGS. 7 and 8 are longitudinal cross-sectional side views of the bottling machine of FIG. 6.

When the respective valves have come to the position *p* in FIG. 6, they again join with an empty bottle 101 supplied from the inlet star wheel 103 as shown on the left side in FIG. 7 to repeat the bottling cycle, and the other bottling valves 120 and the other first and second switching valves 120' and 120'' disposed along the outer circumference of the machine body 8 also move and operate in a similar manner so as to repeat the bottling cycles.

Now a modified beer machine incorporating still another feature of the present invention will be described hereunder. This modified bottling machine has basically the same structure as the beer bottling machine is described above and illustrated in FIGS. 6, 7, 8 and 9, but the former differs from the latter in that the air supplied to the interior of the bottling tank 109 is replaced by carbon dioxide gas, and in that the manifold 109' in FIGS. 7, 8 and 9 is constructed as a vacuum source. Owing to the these differences difference in structure, the modified bottling machine operates as described in the following.

The bottle feed screw 102 feeds the supplied empty bottles 101 to the inlet star wheel 103 under timing control, and the star wheel 103 transfers the empty bottles 101 towards the bottling machine 104. The bottling machine 104 is rotating in the direction indicated by an arrow in FIG. 6. Around the bottling machine 104 are provided bottle pedestals 127 which move round the bottling machine in synchronization therewith, and which receive empty bottles 101 arriving at a position *p* in FIG. 6 from the aforementioned star wheel 103, and support the bottles thereon and thus begin to move the empty bottles 101 in the direction of the arrow. That is, the empty bottle 101 begins to move jointly with the centering bell 126 while maintaining a position directly under the centering bell 126. This position is shown on the left side in FIG. 7. It is to be noted that at this moment blow-out of air in the direction of arrows *a* does not exist. When the bottle pedestal 127 enters a pedestal rising section A in FIG. 6, it rises to raise the bottle 101 and make the neck of the bottle contact with the centering bell 126. Therefore, the centering bell 126 and the bottle 101 are further raised jointly, and when the bottle pedestal 127 has reached a position *q* in FIG. 6, the centering bell 126 is brought into contact with a packing, similar to packing 28 in FIG. 4(II). On the other hand the beer pouring tube 125 is inserted into the bottle 101 during the above-described step of raising the bottle 101.

When the bottle pedestal 127 has reached the position *q* and the centering bell 126 makes contact with the packing as described above, the bottling valve 120 is switched to a position shown in FIG. 4(III) by means of the switching lever 121 and a lever transfer device (not shown), so that a carbon dioxide gas passageway 122 is opened. At the same time, the switching lever 121' for the first switching valve 120' makes contact with the lever transver device 129 as shown on the right side in FIG. 7, so that the first switching valve is switched in such manner that a tank side branch of the carbon dioxide gas passageway may be blocked while a bottling valve side branch of the passageway 122 may be communicated with a vacuum passageway (122'. Consequently, air within the bottle flows in the direction of arrow *f'*, so that the interior of the bottle 101 reaches a substantial vacuum state, that is, a state where about 90% of the air within the bottle has been extracted. Reference character $B_1$ in FIG. 6 designates a pre-evacuating section where the above-described evacuation is effected, and when the bottle 101 comes out of the pre-evacuating section $B_1$, the interior of the bottle 101 has been evacuated to the above-described substantial vacuum state.

When the bottle pedestal 127 enters a counter-pressurizing section $B_2$, the switching lever 121' for the first switching valve 120' leaves the lever transfer device 129 and thereby the first switching valve 120' is restored to its original state, where the tank side branch and the bottling valve side branch of the carbon dioxide gas passageway 122 are communicated with each other and carbon dioxide gas flows in the direction of arrows *b* as shown on the right side in FIG. 8, so that the interior of the bottle 101 is pressurized by the counter-pressure $P_1$ shown at (III) in FIG. 10 (the pressure within the bottling tank 109), and when the bottle pedestal 127 has reached a position *s* in FIG. 6 after passing through the counter-pressurizing section $B_2$, the interior of the bottle 101 is at the same pressure as the interior of the bottling tank 109.

Subseqently, the bottle pedestal 127 enters a bottling section C, where the bottling valve 120 is switched by the switching lever 121 and the lever transfer device to the state shown at (IV) in FIG. 4, so that the carbon dioxide gas passageway 122 is maintained in an opened state, while the beer passageway 123 and the beer pouring tube 125 are communicated with each other. Consequently, beer is poured into the bottle 101 through the passageway 123 and the beer pouring tube 125. This bottling operation continues during the period when the bottle pedestal 127 is passing through the bottling section C, and it has been completed when it reaches a position *t* in FIG. 6. When the bottle pedestal 127 has reached the position *t*, the bottling valve 120 is switched by means of the switching lever 121 and the lever transfer device, so that the carbon dioxide gas passageway 122 and the beer passageway 123 may be blocked.

When the bottle pedestal 127 enters a pedestal lowering section D passing through the position *t*, it falls to lower the bottle 101 which has finished bottling, and eventually to lower the centering bell 126 down to the lower end of the pouring tube 125 and to lower the bottle 101 further below the centering bell 126, as shown on the left side in FIG. 7. It is to be noted that at this moment blow-out of air in the direction of arrows *a* does not exist. The bottle pedestal 127 delivers the bottle 101 thereon to the transfer star wheel 105 when it comes out of the pedestal lowering section D and has reached a position *u* in FIG. 6, and the transfer star wheel 105 transfers the bottle 101 to the capping machine 106. This capping machine 106 applies a crown cap to the bottle 101 and feeds the capped bottle 101 to the outlet star wheel 107, which serves to discharge the filled bottle onto a conveyor line.

On the other hand, the bottling valve 120 and the first and second switching valves 120' and 120" which have moved jointly with the bottle 101 up to the position *u* in FIG. 6, separate from the bottle 101 when they have reached the position *u* and enter a first blow-out section $E_1$ at a position *v* in FIG. 6. At this position *v*, the bottling valve 120 is switched to a position (I) in FIG. 4 by means of the switching lever 121 and the lever transfer device, so that the carbon dioxide gas passageway 122 is opened and the carbon dioxide gas within the bottling tank 109 flows in the direction of arrows *h* as shown on the left side in FIG. 7, and is discharged (blown out) from the end of the passageway 122 in the direction of arrows *a*. It is to be noted that at this moment a bottle 101 is not positioned under the respective centering bell 126. A reference character $T_1$ at (III) in FIG. 10 indicates this blow-out operation. Such a first blow-out operation is effected for the purpose of moving bubbles of beer which adhere to the interior of the carbon dioxide gas passageway 122 towards the bottling valve 120, and therefore, it is only necessary to blow out a small amount of carbon dioxide gas.

The bottling valve 120 and the first and second switching valves 120' and 120" enter a second blow-out section $E_2$ from a position *w* in FIG. 6. As shown on the left side in FIG. 8, at this position *w* the switching lever 121" for the second switching valve 120" makes contact with the lever transfer device 130, so that the second switching valve 120" is switched in such manner that a tank side branch of the carbon dioxide passageway 122 may be blocked, while a bottling valve side branch of the same passageway 122 and the pressurized air passageway 122" may be communicated with each other. Consequently, pressurized air within the manifold 109" flows through the same passageway 122" and the bottling valve 120 in the direction of arrow *g*, and it is blown out from the end of the same passageway 122" in the direction of arrows *a*, as shown on the left side in FIG. 8. Reference character $T_2$ at (III) in FIG. 10 represents this second blow-out operation. Such blow-out operation is effected for the purpose of blowing out bubbles of beer being moved through the passageway 122 towards the bottling valve 120 as well as bubbles of beer adhered to the inside of the bottling valve 120. The second switching valve 120" which has achieved the second blow-out $T_2$ is switched when it comes out of the second blow-out section $E_2$ because the switching lever 121" leaves the lever transfer device 130, so that a tank side branch and a bottling valve side branch of the carbon dioxide gas passageway 122 are communicated with each other, and the passageway 122 and the pressurized air passageway are blocked from each other. At the same time, the bottling valve 120 is switched by means of the switching lever 121 and the lever transfer device, resulting in blocking of the aforementioned passageway 122.

When the respective valves have come to the position *p* in FIG. 6, they again join with an empty bottle 101 supplied from the inlet star wheel 103 as shown on the left side in FIG. 7 to repeat the bottling cycle, and the other bottling valves 120 and the other first and second switching valves 120' and 120" disposed along the outer circumference of the machine body 8 also move and operate in a similar manner so as to repeat the bottling cycles.

It is to be noted that the feeding rate of carbon dioxide gas to the bottling tank 109 is determined according to the following factors:

(I) Assuming that the vacuum within the bottle is 90%, 10% of the air will remain in the bottle. This air is discharged to the interior of the bottling tank 109 as beer is poured into the bottle. Accordingly, the amount of air within the bottling tank 109 is then increased.

(II) The bottle 101 moving from the position *u* in FIG. 6 (a bottle discharge position) towards the capping machine 105 has a space portion not filled with beer in the vicinity of its neck, and the gas mixture (air) within the space portion is discharged to the exterior. In other words, the air within the bottling tank 109 is decreased by the amount equivalent to this discharged air.

(III) The gas mixture within the bottling tank 109 is discharged externally by the first blow-out $T_1$. That is, the air within the bottling tank is decreased by the amount equivalent to this discharged gas. Here, comparing the increment of air in factor (I) above and the decrement of air in factors (II) and (III) above, they are substantially equal in magnitude to each other, and so, carbon dioxide gas is fed through the carbon dioxide gas passageway (III) to the bottling tank 109 by the amount equivalent to the above decrement of the gas mixture. In this way, the interior of the bottling tank 109 is always filled with a mixture gas containing 80 – 90% of carbon dioxide gas.

While the present invention has been described above in connection with preferred embodiments, it is a matter of course that the invention should not be limited to these preferred embodiments, but that various changes in design could be made therefrom without departing from the spirit and scope of the present invention.

What is claimed is:

1. In a method of bottling beer wherein beer is supplied to an empty bottle from a bottling tank containing beer and air under pressure, the improvement comprising:

leading an empty bottle to a first counter-pressurizing section and thereat pressurizing the interior of said bottle by means of pressurized air fed from a pressurized air source separate from said bottling tank and at a pressure less than the pressure of said air in said bottling tank;

then leading said bottle to a second counter-pressurizing section and thereat pressurizing said interior of said bottle by means of pressurized air fed from said bottling tank until said interior of said bottle is at the same pressure as said air within said bottling tank; and thereafter leading said bottle to a bottling section and thereat supplying beer into said bottle.

2. In a method of bottling beer wherein beer is supplied at a bottling section from a bottling tank containing therein beer and pressurized gas through a bottling valve to an empty bottle, wherein a pressurized gas passageway extends from said bottling tank to said bottling valve, and wherein after said step of supplying beer there remain bubbles of beer adhering to the interiors of said pressurized gas passageway and said bottling valve, the improvement comprising:

after completion of said step of supplying beer, leading said pressurized gas passageway and said bottling valve to a first blow-out section and thereat blowing out bubbles from said interior of said pressurized gas passageway toward said bottling valve by passing therethrough a portion of said pressurized gas in said bottling tank; and thereafter leading said bottling valve to a second blow-out section and thereat blowing out bubbles from the interior of said bottling valve by passing therethrough pressurized air from a pressurized air source separate from said bottling tank.

3. In a beer bottling apparatus of the type including a bottling machine having a bottling tank containing beer and pressurized gas, means for feeding empty bottles to said bottling machine, means for supplying beer from said bottling tank to said empty bottles, and means for removing filled bottles from said bottling machine, the improvement comprising:

first counter-pressurizing means, located at said bottling machine at a position downstream of said empty bottle feeding means, for subjecting said empty bottles to a first counter-pressure operation at a pressure less than the pressure of said pressurized gas in said bottling tank by pressurizing said empty bottles from a pressurized air source separate from said bottling tank; and second counter-pressurizing means, located at said bottling machine at a position between said first counter-pressurizing means and said beer supplying means, for subjecting said empty bottles to a second counter-pressure operation by pressurizing said empty bottles with said pressurized gas from said bottling tank until the pressure in said empty bottles equals the pressure within said bottling tank.

4. In a beer bottling apparatus of the type including a bottling machine having a bottling tank containing beer and pressurized gas, means for feeding empty bottles to said bottling machine, means including a bottling valve for supplying beer from said bottling tank to said empty bottles, a pressurized gas passageway extending from said bottling tank to said bottling valve, and means for removing filled bottles from said bottling machine, and wherein after beer is supplied to said empty bottles by said beer supplying means there remain bubbles of beer adhering to the interiors of said pressurized gas passageway and said bottling valve, the improvement comprising:

first blow-out means, located at said bottling machine downstream of said beer supplying means, for subjecting said pressurized gas passageway to a first blow-out operation to remove therefrom said bubbles of beer which may adhere thereto after beer has been supplied to said bottles, by passing said pressurized gas from said bottling tank through said pressurized gas passageway toward said bottling valve; and second blow-out means, located at said bottling machine downstream of said first blow-out means, for subjecting said bottling valve to a second blow-out operation to remove therefrom bubbles of beer adhering thereto after said first blow-out operation, by passing through said bottling valve pressurized air from a source separate from said bottling tank.

5. The improvement claimed in claim 4, further comprising first counter-pressurizing means, located at said bottling machine at a position downstream of said empty bottle feeding means, for subjecting said empty bottles to a first counter-pressure operation at a pressure less than the pressure of said pressurized gas in said bottling tank by pressurizing said empty bottles from a pressurized air source separate from said bottling tank; and second counter-pressurizing means, located at said bottling machine at a position between said first counter-pressurizing means and said beer supplying means, for subjecting said empty bottles to a second counter-pressure operation by pressurizing said empty bottles with said pressurized gas from said bottling tank until the pressure in said empty bottles equals the pressure within said bottling tank.

6. In a beer bottling apparatus of the type including a bottling machine having a bottling tank containing beer and carbon dioxide gas under pressure, means for feeding empty bottles to said bottling machine, means including a bottling valve for supplying beer from said bottling tank to said empty bottles, a pressurized gas passageway extending from said bottling tank to said bottling valve, and means for removing filled bottles from said bottling machine, and wherein after beer is supplied to said empty bottles by said beer supplying means there remain bubbles of beer adhering to the interiors of said pressurized gas passageway and said bottling valve, the improvement comprising:

first blow-out means, located at said bottling machine downstream of said beer supplying means, for subjecting said pressurized gas passageway to a first blow-out operation to remove therefrom said bubbles of beer which may adhere thereto after beer has been supplied to said bottles, by passing said carbon dioxide gas from said bottling tank through said pressurized gas passageway toward said bottling valve; and second blow-out means, located at said bottling machine downstream of said first blow-out means, for subjecting said bottling valve to a second blow-out operation to remove therefrom bubbles of beer adhering thereto after said first blow-out operation, by passing through said bottling valve pressurized air from a source separate from said bottling tank.

7. The improvement claimed in claim 6, further comprising vacuum means, located at said bottling machine downstream of said empty bottle feeding means, for subjecting said empty bottles to a reduced pressure to remove substantially all the air therefrom; counter-pressurizing means, located at said bottling machine at a position between said vacuum means and said beer supplying means, for subjecting said empty bottles evacuated by said vacuum means to a counter-pressure by pressurizing said empty bottles with said carbon dioxide gas from said bottling tank until the pressure in said empty bottles equals the pressure within said bottling tank; and wherein said beer supplying means comprises a beer supply tube extending downwardly to the bottom portion of an empty bottle, and means for passing beer from said bottling tank through said beer supply tube into the bottom of said bottle.

* * * * *